United States Patent [19]

Vakil et al.

[11] 4,031,706

[45] June 28, 1977

[54] SUPERHEATING STEAM FROM LIGHT WATER NUCLEAR REACTORS

[75] Inventors: Himanshu B. Vakil, Schenectady; Dale H. Brown, Scotia, both of N.Y.

[73] Assignee: General Electric Company, Schenectady, N.Y.

[22] Filed: Dec. 18, 1975

[21] Appl. No.: 641,835

[52] U.S. Cl. ..... 60/644; 60/653; 60/676; 60/670; 126/263

[51] Int. Cl.[2] ..... F01K 21/00

[58] Field of Search ..... 60/644, 649, 653, 670, 60/673, 676; 126/263

[56] References Cited

UNITED STATES PATENTS 3,242,053 3/1966 Sanders et al. ..... 60/644

OTHER PUBLICATIONS

G. A. White et al., Fuel 5, 168th ACS National Meeting Atlantic City, New Jersey, Sept. 9–13, 1974.

General Electric Company Technical Report, GETIS 74RD142, July 1974, entitled "Advanced and Improved Power Plant Cycles–Preliminary Evaluation" by D. H. Brown et al.

*Primary Examiner*—Allen M. Ostrager

*Attorney, Agent, or Firm*—Leo I. MaLossi; Joseph T. Cohen; Jerome C. Squillaro

[57] ABSTRACT

Heat from an exothermic chemical reaction(s) is employed to superheat and/or reheat steam generated by a light water nuclear reactor (LWR). The use of such a source of heat enables the selection of a temperature for the heating limited by thermodynamic considerations that eliminates equipment failures due to overheating the heater tubes.

10 Claims, 1 Drawing Figure

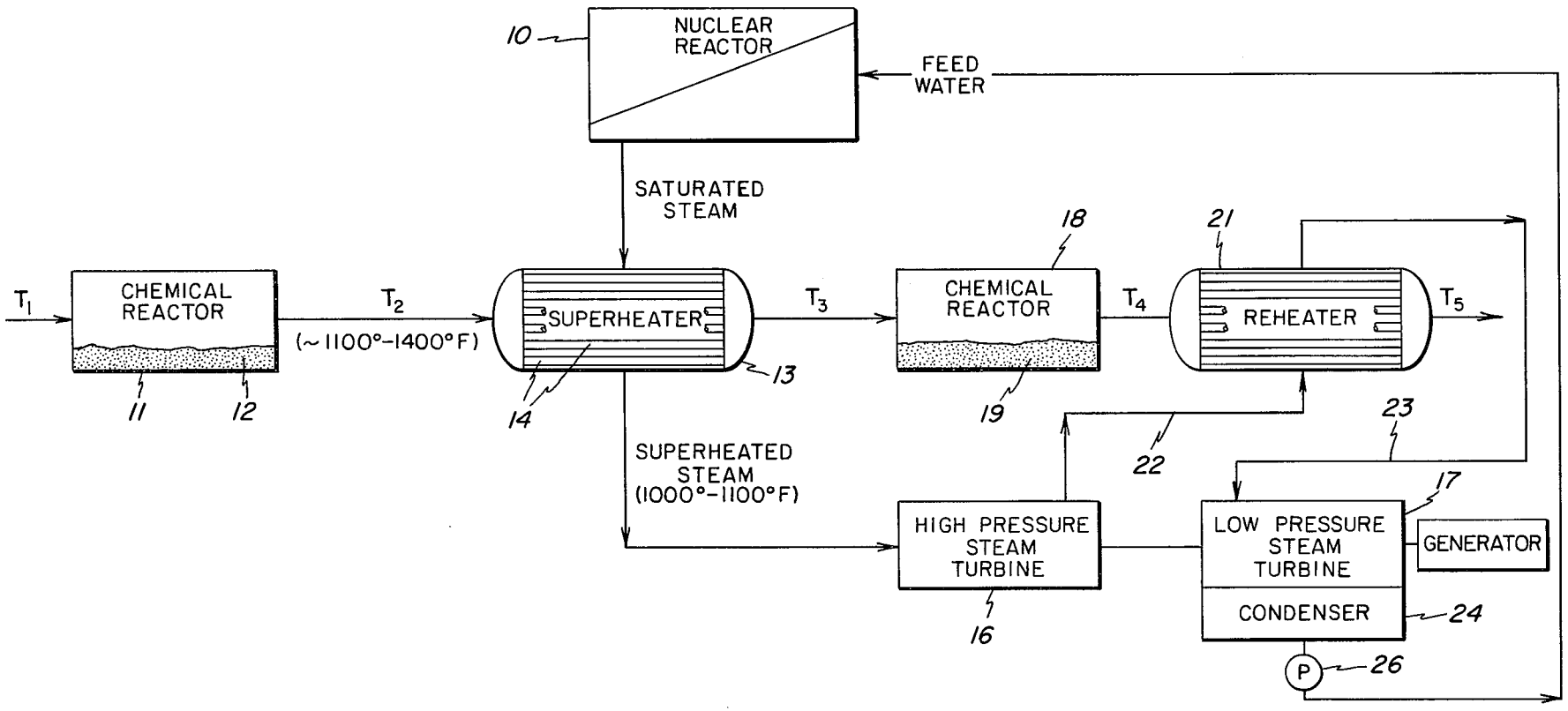
NUCLEAR REACTOR
10
FEED WATER
SATURATED STEAM
CHEMICAL REACTOR
11
12
$T_1$
$T_2$
(~1100°-1400°F)
SUPERHEATER
13
14
$T_3$
CHEMICAL REACTOR
18
19
$T_4$
REHEATER
21
$T_5$
22
23
HIGH PRESSURE STEAM TURBINE
16
SUPERHEATED STEAM (1000°-1100°F)
LOW PRESSURE STEAM TURBINE
17
CONDENSER
24
P
26
GENERATOR

SUPERHEATING STEAM FROM LIGHT WATER NUCLEAR REACTORS

BACKGROUND OF THE INVENTION

Light water nuclear reactors (LWR) typically produce steam at about 1000 psi having little or no superheat. When this steam is expanded in a steam turbine a significant fraction of the flow condenses with a consequent loss of power. Further, so-called "nuclear" turbine designs must be employed having means therein to strip this moisture out of the steam flow path in order to recover efficient turbine performance. This need to remove moisture complicates the turbine design and results in more costly equipment. When reheaters and cross-over moisture separators are employed to reduce the moisture content of the steam flow, penalties in the form of pressure losses are introduced in the system.

Attempts have been made to improve the efficiency of LWR power generating plants by the utilization of fossil-firing to superheat the steam output and then introducing this superheated steam to a conventional steam turbine-generator set. The major shortcoming of this simple solution, however, is the combination in such a superheater of extremely high combustion temperatures and low heat transfer coefficients. This combination presents the ever-present risk of increased reactor down-times resulting from overheating of the superheater tubes and consequent failures of fossil-fired superheaters.

There is a very definite need for means for superheating steam from LWR's without danger of overheating the superheater tubes. The instant invention offers one solution to the problem.

Superheating or reheating are defined as increasing the temperature of steam substantially above its saturation temperature. Steam produced in a light water reactor has a temperature of about 550° F. It is preferable to be able to raise this temperature to about 1000°-1100° F., thereby significantly improving the efficiency of power generation by LWR's. In the case of reheating, the steam product stream from a LWR may have passed through rotating equipment before the reheating step is accomplished to increase the temperature of the steam substantially above its saturation temperature.

DESCRIPTION OF THE INVENTION

In the present invention, an exothermic chemical reaction is employed to provide the heat to a superheater or reheater for steam from a LWR. Since the maximum attainable temperature for the chemical reaction is limited by thermodynamic considerations, the danger of overheating the superheater or reheater tubes whereby the design capability thereof is exceeded is obviated. At the same time, an exothermic chemical reaction is readily selectable to provide temperatures for the heating function significantly greater than 550° F. and ranging to greater than 1200° F. Exemplary exothermic reactions are methanation, oxidation of sulfur dioxide, and hydrogenation. Methanation is the preferred reaction, because it can be used to provide temperatures in the 1100°-1400° F. range and catalytic methanators producing product gases in this temperature range have been described in the literature as being available within the present state of the art.

BRIEF DESCRIPTION OF THE DRAWINGS

The features of this invention believed to be novel are set forth with particularity in the appended claim. The invention itself, however, as to the organization, method of operation, and objects and advantages thereof, may best be understood by reference to the following description taken in conjunction with the accompanying drawing schematically illustrating apparatus for utilizing an exothermic chemical reaction in the superheating and reheating of steam from a nuclear reactor (i.e., a boiling water reactor or a pressurized water reactor).

Method and Process of Making and Using the Invention

Steam is generated in LWR 10 and is discharged at about 550° F. The incidence of materials problems prevents the attainment of higher steam temperatures. Reactants at $T_1$ enter chemical reactor 11 containing catalyst system 12. As the chemical reaction proceeds, the gaseous reactants leave chemical reactor 11 at a higher temperature ($T_2$) preferably about 1100°-1400° F., and enter superheater 13 where these gaseous products pass through superheater tubes 14 surrounded by the saturated steam from reactor 10.

Variations of this arrangement for superheating may, of course, be employed. For example, both the chemical reactor and the superheater can be housed in a common vessel, with the catalyst system surrounding the steam superheating tubes.

As the result of this heating, the steam is superheated, preferably to the 1000°-1100° F. range, at which temperature it is suitable for use in a conventional high pressure steam turbine 16 mechanically coupled with the low pressure steam turbine 17 of a steam turbine-generator set. However, significant advantage is gained even by superheating to about 650° F. Thus, in a 3000 megawatt (MW) thermal plant superheating to this temperature will provide superheat duty of about 250 $MW_{th}$.

As the result of giving up heat in superheater 13, the gaseous reactants have reached a lower temperature ($T_3$) and are suitable for carrying on a subsequent exothermic chemical reaction in reactor 18 containing catalyst bed 19. Thus, the gaseous reactants leave superheater 13 and enter reactor 18 for a repetition of the exothermic chemical reaction produced in reactor 11 thereby once again raising the temperatures of the gaseous products to a range at which the gaseous reaction products (at $T_4$) in passing through reheater 21 are able to superheat the exhaust from high pressure steam turbine 16 entering via conduit 22. The reheated steam is then conducted from reheater 21 to the low pressure steam turbine 17 of the steam turbine-generator set via conduit 23 for the generation of additional power.

The arrangement described hereinabove is given by way of example in that the steam product stream from reactor 10 could have been directed through a high pressure "nuclear" steam turbine (or other rotating equipment) and then conducted to the reheater 21 to accomplish the reheating by the practice of this invention.

The combined mechanical energy outputs from high pressure steam turbine 16 and the low pressure steam turbine 17 of steam turbine-generator set is considerably higher than would be obtainable without superheating. For example, the addition of 1270 $MW_{th}$ of high grade heat to the steam output from a 1000 $MW_e$ LWR (33% efficiency) will increase the total output to 1660 $MW_e$. If the heat rate of 10,350 BTU per kilowatt-hour is attributed to the first 1000 $MW_e$ of this generation, then the additional 660 $MW_e$ is being realized at an incremental heat rate of 6560 BTU per kilowatt-hour, i.e., an efficiency of 52%.

The steam leaving low pressure steam turbine 17 enters condenser 24 from which it is pumped via pump 26 as feed water for the LWR.

Exemplary exothermic chemical reactions are set forth as follows:

| | |
|---|---|
| 1. Methanation | $CO + 3H_2 \rightleftharpoons CH_4 + H_2O$ |
| | $2CO + 2H_2 \rightleftharpoons CO_2 + CH_4$ |
| 2. Oxidation/Reduction | $SO_2 + \frac{1}{2}O_2 \rightleftharpoons SO_3$ |
| 3. Hydrogenation | $C_6H_6 + 3H_2 \rightleftharpoons C_6H_{12}$ |
| | $C_7H_8 + 3H_2 \rightleftharpoons C_7H_{14}$ |

The reaction conducted in reactor 11 may be carried on by the catalytic conversion of mixtures of carbon oxides to methane using nickel methanation catalysts as is described in White, G.A. et at., FUEL 5, 168th ACS National Meeting, Atlantic City, New Jersey, Sept. 9–13, 1974.

If desired, the gaseous constituents for the methanation reaction may be obtained at the delivery end of a closed loop chemical system for energy transmission, storage and distribution, such as is described in U.S. patent application Ser. No. 484,802 – Wentorf, Jr., filed July 1, 1974. now U.S. Pat. No. 3,938,625. The Wentorf application is assigned to the assignee of the instant invention. Both the American Chemical Society paper and the Wentorf application are incorporated by reference.

Closed cycle chemical systems based on hydrogen and carbon monoxide (HYCO) are capable of transmitting high grade thermal energy from a high temperature source (e.g., a high temperature gas reactor, minemouth fossil plant, or focused solar furnace yielding a temperature $\geqslant$ 950° K) via pipeline over distances of 100 – 300 miles efficiently and economically. At the delivery location, it is possible to achieve temperature in the range of 800° K to 1050° K (~1000° F. to 1430° F). It is not possible for the maximum temperature in this system to rise much above 1100° K because at higher temperatures the reaction in the HYCO system reverses causing large quantities of heat to be absorbed and thus lowering the temperature. This temperature range of 800° K to 1050° K is adequate for supplying the necessary high grade heat to improve the LWR efficiency.

One arrangement employing the HYCO-type transmission would transport energy from a single high temperature source to several BWR/PWR's within a range of 100 – 300 miles. The storage capacitance inherent in such a pipeline system permits the system to augment the LWR output either on a base-load or on a peaking basis.

Thus, by the practice of this invention a LWR can be used more efficiently providing an overall increase in the capability for generating electric power.

The use of the closed loop chemical system with its capability for modulating the pipeline pressure provides a built-in peaking and storage ability.

One of the most important considerations is the insurance in the practice of this invention that the maximum temperature in the superheaters cannot exceed the maximum adiabatic reaction temperature, which is a fixed predetermined temperature (e.g., 800° C). Thus, the superheater tubes are in no danger of being overheated and the overally system for power generation achieves increased reliability.

It is contemplated that this invention encompasses arrangements in which the heat from the exothermic chemical reaction is delivered to the nuclear product stream by any heat transport agency, e.g., via an intermediate heat transfer loop.

The best mode contemplated has been disclosed herein in the use of the exothermic methanation reaction to superheat the pressurized steam generated by an LWR to a temperature of at least 650° F.

What we claim as new and desire to secure by Letters Patent of the United States is:

1. In a process for heating the pressurized steam product stream produced by heat generated in a light water nuclear reactor wherein the steam product stream is brought into heat exchange relationship with a high temperature source in a heat exchange device and the temperature of the steam product stream is increased to at least about 650° F. after which the superheated steam so produced is used to operate a steam turbine-generator set, the improvement comprising using a combustion-less exothermic chemical reaction for the generation of heat utilized for the heating step, said exothermic chemical reaction having a maximum attainable temperature limited by thermodynamic considerations to a value below the design capability of any component of said heat exchange device exposed thereto.

2. The improvement recited in claim 1 wherein the chemical reaction is methanation.

3. The improvement recited in claim 2 wherein the temperature of the methanation reaction is in the range of from about 1100° to about 1400° F.

4. The improvement recited in claim 1 wherein the chemical reaction is an oxidation-reduction reaction.

5. The improvement recited in claim 1 wherein the chemical reaction is hydrogenation.

6. The improvement recited in claim 1 wherein the exothermic chemical reaction is conducted at the delivery end of a closed loop chemical system.

7. The improvement recited in claim 6 wherein the chemical reaction is methanation.

8. The improvement recited in claim 1 wherein the superheated steam is supplied to a high pressure steam turbine, reheated with heat from an additional exothermic chemical reaction and then supplied to a low pressure steam turbine.

9. The improvement in claim 8 wherein the initial chemical reaction is methanation and the cooled products of the initial reaction are then reacted to provide the additional chemical reaction.

10. The improvement recited in claim 1 wherein the superheated steam produced has a temperature in the range of from about 1000°–1100° f.

* * * * *